US005512368A

United States Patent [19]

Harmer et al.

[11] Patent Number: 5,512,368

[45] Date of Patent: Apr. 30, 1996

[54] FIBERS REINFORCED WITH INORGANIC WHISKERS

[75] Inventors: Mark A. Harmer; Brian R. Phillips, both of Wilmington, Del.

[73] Assignee: E. I. Du Pont de Nemours and Company, Wilmington, Del.

[21] Appl. No.: 405,121

[22] Filed: Mar. 16, 1995

[51] Int. Cl.[6] ..... B32B 19/06; C08G 63/183; C08K 3/00

[52] U.S. Cl. ..... 428/364; 524/492; 524/493; 524/495; 524/497; 525/419; 525/420; 525/432; 528/190; 528/332; 528/335

[58] Field of Search ..... 428/364; 524/492, 524/493, 495, 497; 525/419, 420, 432; 528/190, 332, 335

[56] References Cited

U.S. PATENT DOCUMENTS

| | | | |
|---|---|---|---|
| 4,067,852 | 1/1978 | Calundann | 528/190 |
| 4,075,262 | 2/1978 | Schaefgen | 525/444 |
| 4,176,223 | 11/1979 | Irwin | 528/170 |
| 4,447,592 | 5/1984 | Harris, Jr. | 528/128 |
| 4,564,669 | 1/1986 | Dicke et al. | 528/173 |
| 4,799,985 | 1/1989 | McMahon et al. | 156/166 |
| 5,110,896 | 5/1992 | Waggoner et al. | 528/190 |
| 5,232,970 | 8/1993 | Sole et al. | 524/404 |
| 5,248,360 | 9/1993 | Jones, Jr. et al. | 156/166 |
| 5,411,793 | 5/1995 | Ide et al. | 428/215 |

FOREIGN PATENT DOCUMENTS

| | | | |
|---|---|---|---|
| 63-243315 | 10/1988 | Japan | D01F 1/10 |

*Primary Examiner*—Shelley A. Dodson

[57] ABSTRACT

Disclosed herein are organic polymeric fibers containing inorganic whiskers. The fibers are made from polymers which are anisotropic. Such polymers include, for example, certain aramids and polybenzobisthiazoles. The physical properties of the fibers are improved, and are useful, for example, in ropes and composites.

10 Claims, No Drawings

FIBERS REINFORCED WITH INORGANIC WHISKERS

FIELD OF THE INVENTION

This invention concerns fibers made from anisotropic polymers reinforced with inorganic whiskers.

TECHNICAL BACKGROUND

It is known to reinforce certain polymeric materials or organic fibers with inorganic high-strength/modulus fibers called whiskers or microfibrils. It has been reported, for example, that organic fibers made from melt-processable synthetic polymers can be reinforced with inorganic whiskers.

Japanese Patent Application 63-243,315 discloses a fiber made of melt-processable organic polymers containing inorganic whiskers. No mention is made, in this reference, to non-melt processable polymers or to anisotropic polymers.

Applicant has now found other materials in which synthetic organic polymers can be advantageously reinforced with inorganic whiskers. Fibers made from anisotropic polymers, including non-melt processable polymer fibers, can be reinforced with inorganic whiskers. Such fibers show improved properties, including improved compressive strength, which can improve their performance or increase their uses. For example, such fibers are useful in composites, which are typically a combination of a fiber material and a matrix resin. As one example, such a composite might be used for making structural parts in aircrafts.

SUMMARY OF THE INVENTION

This invention concerns a composition comprising a fiber material made of an organic polymer which is anisotropic. The invention is applicable to fiber materials made from polymers which are anisotropic and melt-processable or which are anisotropic and non-melt processable. Such a composition also contains inorganic whiskers in the amount of about 0.1 to 50 percent by volume of the total volume of the organic polymer and inorganic whiskers.

DETAILS OF THE INVENTION

As indicated above, the present invention is directed to a fiber material (or "fiber") made from one or more synthetic organic polymers that contain inorganic whiskers. By the term "fiber" or "fiber material" is meant any fiber made from an organic polymer, which organic polymer and fiber are formed by man. As used herein, the term "fiber" also means, as in common usage, a material wherein the longest cross-sectional dimension (perpendicular to the longest dimension) is about 1000 micrometers (μm) or less. Preferably, the fiber has a largest cross-sectional dimension of 100 μm or less. Most fibers have a circular cross section, so this cross-sectional dimension would usually be the diameter of this circle.

According to the present invention, the polymer from which the fiber is made anisotropic, and non-melt processable or melt processable. The invention is particularly unconventionaly with respect to fibers made from non-melt processable polymers. By the term "non-melt processable" or the like is meant the polymer cannot be commercially formed into a fiber by melting, shaping of the melt, and cooling. Non-melt processable polymers typically include polymers whose melting and/or softening points are above their decomposition points so that if one attempted to form a melt from such a polymer, the polymer would decompose. For example, many aramids and polyimides are non-melt processable. Such polymers may instead be solution processed, that is, a solution of the polymer is made and subsequently the final shape such as a film or fiber is made using this solution. Such a fiber is made by spinning, for example, by wet or dry spiraling. See, for example, H. Mark et al., Ed., *Encyclopedia of Poller Science and Engineering*, Vol. 6, p. 802–839 (2d Ed. John Wiley & Sons, New York) for a description of solution processing, including wet or dry spinning. See also D. Tanner, J. A. Fitzgerald and B. R. Phillips, Adv. Mater, 5 (1989) 151.

By an "anisotropic polymer" is meant one whose polymer chains show order, and in the case of a fiber, are aligned preferentially along the long axis of the fiber. Such polymers include, for instance, non-melt processable aramids, melt processable aramids, non-melt processable polybenzobisthiazoles, and thermotropic liquid crystalline polymers. The polymer chains may be aligned either by spinning or, afterwards, while drawing the fiber. Such polymers tend to have very good tensile strength and modulus, but poor properties in compression. Compression properties are believed to be poor because the aligned polymer chains of the anisotropic polymer tend to buckle under compressive load. It has now been found that when inorganic whiskers are present, compression properties are significantly improved.

A couple of preferred classes of synthetic organic polymers are aramids and polybenzobisthiazoles which are anisotropic, that is, can exhibit high molecular orientation in fiber form, such as poly(p-phenylene terephthalamide) and poly(p-phenylene benzobisthiazole) which are not melt processable, and poly(3,4'-oxybiphenylene terepthalamide) which is melt processable. Not included in this invention are non-anisotropic aramids such as poly(m-phenylene isophthalamide), which also happens not to be melt processable. Other anisotropic (and melt processable) polymers, which can be suitably employed in the present invention, are thermotropic liquid crystalline polymers. Examples of such polymers are disclosed in U.S. Pat. Nos. 4,447,592, 4,075,262, 4,176,223, 5,110,896, 4,564,669, and 4,067,852, which patents are all hereby incorporated by reference in their entirety.

The whiskers employed in the present invention are inorganic materials, preferably having high module and tensile strengths. By the term "whiskers" herein is meant particles with an average aspect ratio [length, defined as the longest dimension, divided by the largest cross-sectional dimension perpendicular to the length] of about 5 or more, preferably 5 to 100, more preferably 5 to 50. Typically, the largest cross-sectional dimension (usually a diameter, since the cross section is usually circular) is, on average, about 0.1 to 1.5 μm, and the average length is about 2 to 20 μm. Preferably, the whiskers have a relatively uniform diameter.

Suitable materials for whiskers include, but are not limited to, SiC, $Si_3N_4$, carbon, $Al_2O_3$, $SiO_2$, BN, and $TiB_2$. Suitable materials for whiskers include carbon nanotubes. See, for example, T. W. Ebbersen and P.M. Ajayan, "Large Scale Synthesis of Carbon Nanotubes", Nature, Vol. 358, page 220 (1992). Preferably, the whiskers are made of silicon carbide (SIC) or silica ($SiO_2$), most preferably silicon carbide. The optimal whisker material, aspect ratio, diameter, means and quality of dispersion, etc, depends on the particular composition or fiber system involved and its intended use.

The maximum cross-sectional dimension of a whisker used to reinforce any particular fiber should preferably be less 20% of the minimum cross-sectional dimension of the synthetic fiber, more preferably less than 10%. The whiskers make up about 0.1 to 50, preferably 1 to 20, volume percent of the total composition or fiber material.

For those materials, according to the present invention, from which the fiber can be formed from the melt, the whiskers can be added to the melt and dispersed by mechanical stirring or other conventional means for dispersing or mixing. The fibers are then formed, typically by extrusion of the melt. The fibers may be drawn or otherwise reduced in diameter. For materials which are non-melt processable, for instance, some aramids from which fibers are formed from solution, the whiskers can be dispersed in solution and then the solution "extruded" to form the fiber. Most of these methods tend to align the long axis of the whiskers parallel with the long axis of the fiber. This is usually advantageous, as this alignment further improves properties of the fiber measured along the long axis of the fiber, as is usually desired. Use of the above methods to make the synthetic-fiber and inorganic-whisker composition means that the whiskers should not melt or otherwise degrade or lose their shape during the processes just described or during use of the composition.

In certain cases, it may be advantageous to improve the "adhesion" of the inorganic whisker to the synthetic organic polymer. This can be done in various ways, depending on the make up of the synthetic organic fiber and inorganic whisker. For instance, if a synthetic organic polymer such as an aramid is used for the fiber. The whisker may be coated with an appropriate material which increases adhesion between the two. Such an adhesion promoting or coupling agent includes silicon or titanium containing materials, as for example, disclosed by E. P. Plueddemann in "Silane Coupling Agents," (Plenum Press, New York 1991).

A particular property, or set of properties, of a synthetic-organic-polymer fiber may be improved by employing an inorganic whisker having a corresponding property, or set of properties, that is higher (better) than that of the synthetic fiber without the whiskers present. For instance, if one wishes to increase the tensile modulus and/or strength and/or compressional modulus of a synthetic fiber, the corresponding properties of the inorganic whisker which is used are preferably lighters than those of the synthetic fiber.

The whisker-reinforced fibers described herein may be designed for various applications such that they have improved properties that are valuable for the particular application in mind, as will be appreciated by the skilled artisan. For example, compositions according to the present invention may be valuable for advanced composites, where synthetic fibers are often used as stiffening or reinforcing material to improve the properties of the composite.

EXAMPLE 1

Silicon carbide was supplied from Advanced Composite Materials Corporation (Greet, SC). The average diameter of the whiskers was 0.6 μm with an average length of 20 μm, with a range of 5–25 μm (density 3.2 g per cm). Silicon-carbide whiskers in the amount of 18.1 g were added to 223 g of concentrated sulfuric (Oleum). The silicon-carbide/sulfuric-acid mixture was ultra-sonicated using a Heat Systems™ (64 cm) ultrasonic probe, under a nitrogen atmosphere to ensure good mixing of the whiskers in the acid. The silicon carbide/sulfuric acid mixture was transferred in to a commercially available Atlantic Mixer™, Model 2CV (¼ pint in size), available from Helicome Research Corporation. The acid mixture was frozen using dry ice, and then 51.9 g of poly(p-phenyleneterephthalamide), also known as PPD-T, was added. The mixture was allowed to warm up, and the mixture was heated and mixed at 85° C. for one hour. The resultant spin dope was then transferred into a single hole spinneret spin cell, and single filament fibers were spun using a spinneret of 0.08 mm diameter. The spinning temperature was 80° C. and the fibers were spun and drawn into ice water. For a 0.08 mm spinneret, typical spinning conditions were 16 m per min. jet velocity, 192 m per min. wind-up velocity (with a spin stretch factor of 11.8), coagulating into water at about 8° C. Fiber was collected onto a wheel. The fiber was washed with water and neutralized to a pH of about 7 with sodium bicarbonate and, finally, dried or might in an oven at 90° C. Using this procedure, a microcomposite fiber, light green due to the silicon carbide, was obtained which contained 25 wt % of silicon carbide within the fiber material.

COMPARATIVE EXAMPLE 2

The above process of Example 1 was repeated with the exception that no silicon carbide was added to the spin dope mixture, thus serving as a control. This control fiber was light yellow. The comparative properties are described in reference to Example 3 below.

EXAMPLE 3

Fibers prepared as described in Example 1 (silicon carbide composite) and Comparative Example 2 (control) were subjected to recoil compressional forces. Typically the fiber was held, between two rigid clamps, in an Instron™ mechanical testing instrument and a load applied. The fiber was then cut, which caused the fiber to recoil and the compressional force was directly related to the force applied. This is well known in the an and has been described in detail by S. Allen, J. Mat. Sci., 22 (1987) 853. Compressional forces of 6 GPD (grams per denier) were applied. Under these compressional forces, which are about three times the value of the compressive strength of commercial PPD-T (with compressive strengths of about 2 GPD), the control fiber was found to buckle and fail under compression. The failure mode is seen very clearly by examining the scanning electron micrographs of the failed fiber. The fiber failed by forming well defined kink bands (for examples of the various failure modes see M. A. Harmer, et at., J. Mat. Sci. Lett., Vol. 13, p. 930–933 (1994)). In some cases complete buckling of the fiber is obtained. The kink bands and buckling cross or traverse the fiber. This failure mechanism is well known in the art for these types of highly oriented polyaramide fibers. The silicon carbide/PPD-T microcomposite when tested under the same conditions did not show kink bands or complete buckling of the fiber. No evidence was found of kink bands traversing all the way across the fiber, and complete buckling of the fiber was not observed. In a few cases, where shear (start of a kink) was observed, this was stopped by the presence of the silicon carbide whisker. The micrographs also showed that the silicon-carbide whiskers were aligned in the same direction as the fiber and interfered with the failure mechanism of the fiber under compression.

EXAMPLE 4

The compressive strength of both the SiC/PPD-T microcomposite fibers (from Example 1 ) and the control (from Comparative Example 2), were measured using the recoil test as described in the literature (see Example 3). The compressive strength of the control PPD-T fibers were in the range of 0.22 to 0.28 GPa (measured on three sets of fibers and about 40 samples taken for each fiber). In the case of the silicon carbide/PPD-T microcomposite, generally the failure was much more difficult to observe even at higher loads. Bends (not kink bands) in the fiber were observed but at a higher range of between 0.31 to 0.6 GPa (measured on three sets of fibers and about 40 samples taken from each fiber). It was found, for example, that applying a force equivalent to a compressive failure of about 0.55 GPa caused well defined kink bands in all of the control fibers and lateral shear is obtained. In the case of the microcomposite a number of fibers were examined (20), however, none of these showed signs of kink bands or shearing.

What is claimed is:

1. A composition comprising a fiber made of an aramid or polybenzobisthiazole polymer which is anisotropic, and inorganic whiskers in the amount of 0.1 to 50 percent by volume of said composition.

2. The composition as recited in claim 1 wherein said inorganic whiskers are about 1 to 20 volume percent of said composition.

3. The composition as recited in claim I wherein said organic polymer is non-melt processable.

4. The composition as recited in claim 1 wherein said organic polymer is melt processable.

5. The composition as recited in claim 1 wherein said organic polymer is an aramid.

6. The composition as recited in claim 5 said organic polymer is selected from the group consisting of poly(p-phenylene terephthalamide, poly(p-phenylene benzobistbiazole), and poly(3,4'-oxybiphenylene terephthalamide).

7. The composition as recited in claim 1 wherein said aramid is poly(p-phenylene terephthalamide.

8. The composition as recited in claim 1 wherein said inorganic whiskers are selected from the group consisting of SiC, $Si_3N_4$, carbon, $Al_2O_3$, $SiO_2$, BN, and $TiB_2$.

9. The composition as recited in claim 7 wherein said inorganic whiskers are SiC.

10. The composition as recited in claim 1 wherein said inorganic whiskers are SiC.

* * * * *